United States Patent [19]

Kurtz

[11] 4,333,395

[45] Jun. 8, 1982

[54] CONTAINER CRUSHING DEVICE

[76] Inventor: Garrett W. Kurtz, 946 Main Ave., Durango, Colo. 81301

[21] Appl. No.: 120,141

[22] Filed: Feb. 11, 1980

[51] Int. Cl.[3] ..... B30B 7/00; B30B 9/32

[52] U.S. Cl. ..... 100/233; 100/257; 100/293; 100/295; 100/902

[58] Field of Search ..... 100/293, 295, 257, 233, 100/902; 241/99, 150; 99/579, 581, 583

[56] References Cited

U.S. PATENT DOCUMENTS

| | | | |
|---|---|---|---|
| 255,715 | 3/1882 | Birkholz | 241/100 |
| 938,462 | 11/1909 | Carter | 100/233 |
| 1,017,821 | 2/1912 | Swickard | 100/293 |
| 1,109,363 | 9/1914 | Rosen | 100/293 |
| 2,426,120 | 8/1947 | Posey | 99/581 |
| 2,446,898 | 8/1948 | Alvarez | 100/DIG.2 |
| 2,466,907 | 4/1949 | Nadolny | 100/DIG. 2 |
| 2,603,270 | 7/1952 | Voigt | 100/DIG. 2 |
| 2,707,503 | 5/1955 | Johnson | 100/DIG. 2 |
| 3,043,212 | 7/1962 | Hasselquist | 100/DIG. 2 |
| 3,299,802 | 1/1967 | Black | 100/DIG. 2 |
| 3,667,386 | 6/1972 | Workman | 100/DIG. 2 |
| 3,776,129 | 12/1973 | Carlson | 100/DIG. 2 |
| 3,777,659 | 12/1973 | McCarten | 100/DIG. 2 |
| 3,804,004 | 4/1974 | Krebs | 100/DIG. 2 |
| 3,853,054 | 12/1974 | Jacobsen | 100/DIG. 2 |
| 3,948,164 | 4/1976 | Pobuda | 100/DIG. 2 |
| 4,058,054 | 11/1977 | Markman | 100/DIG. 2 |
| 4,168,661 | 9/1979 | Wigdahl | 100/DIG. 2 |
| 4,197,796 | 4/1980 | Salatka | 100/DIG. 2 |

FOREIGN PATENT DOCUMENTS

| | | | |
|---|---|---|---|
| 1289001 | 2/1969 | Fed. Rep. of Germany | 100/DIG. 2 |
| 1156139 | 6/1969 | United Kingdom | 100/DIG. 2 |

*Primary Examiner*—Billy J. Wilhite

*Attorney, Agent, or Firm*—Jack E. Ebel; Stephen A. Gratton

[57] ABSTRACT

A device for crushing metal containers to facilitate recycling the containers, the device having a base and an operating lever pivotally secured to the base. The base has a base shoe sized to receive one end of a metal container and the operating lever has a crushing shoe at one end thereof. The crushing shoe has an annular groove formed in one face and sized to receive the other end of the metal container.

7 Claims, 6 Drawing Figures

CONTAINER CRUSHING DEVICE

BACKGROUND OF THE INVENTION

This invention relates to devices for crushing metal containers, and more particularly, to a device for crushing generally cylindrical metal cans thereby reducing the bulk and facilitating recycling thereof.

Metal containers, especially generally cylindrical metal cans, are conventionally utilized to transport and store beverages and foods in the consumer chain. The ever increasing marketplace demand for such metal containers coupled with exhaustible worldwide supplies of ores containing metal, such as aluminum, used in fabricating such containers has rendered recycled containers an attractive source of such metal. Currently, several metal container manufacturers redeen used metal containers recycled by the consumer. Metal recycling not only retards the exhaustion of finite metal ore supplies, but also, reduces the litter caused by improper disposal of metal containers.

One problem encountered in recycling metal containers is the shear bulk created by a plurality of containers. As accumulation of a relatively large number of metal containers prior to redemption thereof is economically desirable to consumers, reducing the bulk of each metal container is important to facilitate recycling. Several prior art devices have been proposed to reduce the bulk of containers, U.S. Pat. Nos. 2,446,898 to Alvarez, 2,603,270 to Voight et al and 3,948,164 to Pobuda et al disclose can crushing or flattening devices which are manually operated. U.S. Pat. Nos. 2,466,907 to Nadolny et al, 3,299,802 to Black, 3,776,129 to Carlson and 3,804,004 to Krebs relate to can crushing or flattening devices which are operated by pedals. In the operation of each of these prior art can crushing or flattening devices, the crushed or flattened can must be manually removed from the device. Other prior art can crushing or flattening devices, such as U.S. Pat. Nos. 3,777,659 to McCarten, 3,853,054 to Jacobsen and 4,058,054 to Markman, require changing the orientation of the can during crushing by manual manipulation thereof. Such manual removal or manipulation of a crushed can is cumbersome and exposes the operator of the device to risk of physical injury caused by sharp and jagged edges of the crushed can. Additionally, U.S. Pat. Nos. 3,043,212 to Hasselquist and 3,667,386 to Workman relate to can crushing or flattening devices which require the operating handle of the device to be manipulated through a series of strokes so as to crush a can. Several of these prior art devices have a relatively complex construction.

Thus, a need exists for a device for crushing metal containers, especially generally cylindrical metal cans, which does not require manual manipulation of the container during or after crushing, which is of relatively simple, dependable and economical construction and which requires the operating handle to be manipulated through only a single stroke to activate the device.

BRIEF SUMMARY OF THE INVENTION

The present invention relates to a device for crushing metal containers, especially generally cylindrical metal cans, to reduce the bulk and facilitate recycling thereof. The container crushing device has a base and an operating lever pivotally secured thereto. The base has a base shoe sized to receive one end of metal container. The base also has a pair of correspondingly configured and sized support arms which extend outwardly in a substantially parallel manner. The operating lever is pivotally secured to the support arms and has a crushing shoe at one end thereof. The crushing shoe has an annular groove formed in one face thereof, defining a raised central portion having a beveled edge and a raised annular portion. The groove is sized to receive the other end of a metal container, the beveled edge serving to aid in positioning the other container end within the groove. A collector may be secured to the base to provide a receptacle for collecting crushed cans.

BRIEF DESCRIPTION OF THE DRAWINGS

The invention will be more readily understood by reference to the accompanying drawing wherein like reference numerals indicate like elements throughout the drawing figures and in which.

DETAILED DESCRIPTION

Figure 1:
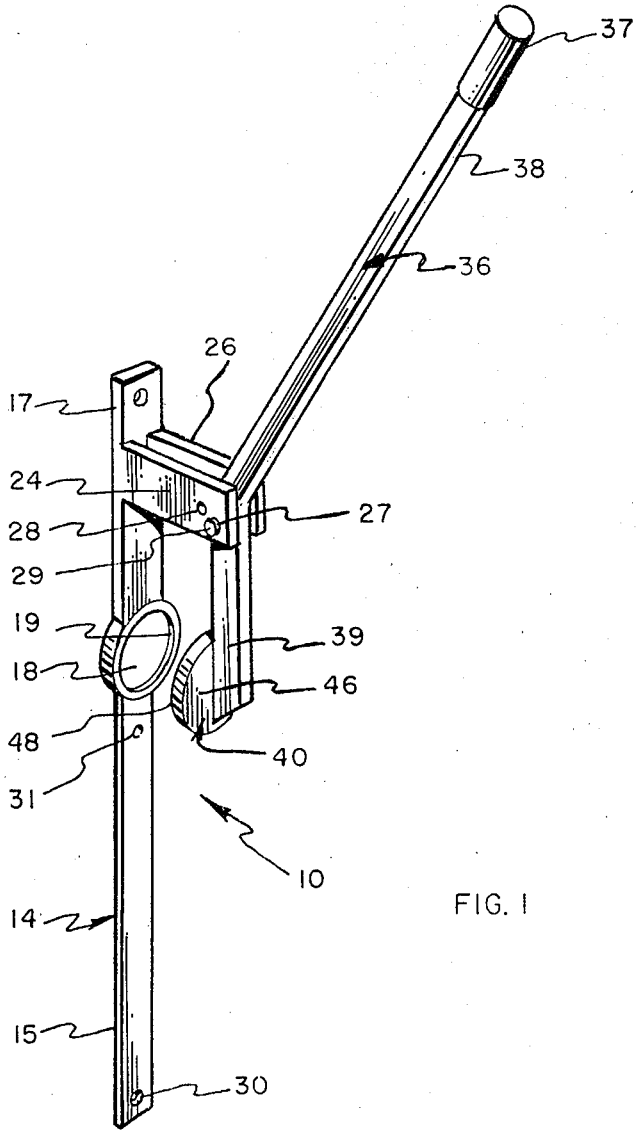
FIG. 1 is a perspective view of the container crushing device of the present invention as fully assembled.

Referring to FIG. 1, the container crushing device of the present invention is illustrated generally as 10. Container crushing device 10 has a base 14 and an operating lever 36 pivotally secured thereto as hereinafter described. Base 14 has a first portion 15, a base shoe 16 and a second portion 17. First portion 15 is an elongated strip of suitable material having relatively uniform thickness. Second portion 17 is also an elongated strip of suitable material of relatively uniform thickness, second portion 17 preferably being of a greater thickness than first portion 15. Base shoe 16 is positioned intermediate first portion 15 and second portion 17, and may be integral therewith, such as where base 14 is formed by molding, or fixedly secured thereto by any suitable means, such as welds. Base shoe 16 has a generally circular base plate 18 and an annular retaining ring 20 integral with and having a substantially identical peripheral configuration as base plate 18. The internal surface of the annular retainer ring forms a sidewall 19 with respect to base plate 18, sidewall 19 being of a substantially uniform thickness about the entire circumference thereof. The inner diameter of annular retaining ring 20 is sized so as to receive one end of a metal container in such a manner as hereinafter described.

A pair of correspondingly sized support bars 24 and 26 are fixedly secured to or integrally formed with second portion 17. Support bars 24 and 26 extend in a generally perpendicular manner from second portion 17 and are substantially parallel. Each support bar is provided with at least one, and preferrably a plurality of apertures 27 and 28, which are axially aligned with a corresponding aperture in the other support bar. Thus, a pin 29 may be inserted through one set of aligned apertures for purposes hereinafter described. The exact positioning of support bars 24 and 26 along the length of second portion 17 will depend upon, inter alia, the relative dimensions of second portion 17 and operating lever 36, although it is preferred to position support bars 24 and 26 approximately at the mid point of second portion 17 to ensure structural integrity of the second portion. Support bars 24 and 26 may be integrally formed with second portion 17, such as by molding, or may be fixedly secured thereto, for example, by means of welds. Base 14 is provided with a plurality of spaced bores 30, 31 and 32, for fixedly securing base 14 to a structure, such as a frame or wall, by any suitable means, for example screws, bolts or nails. Preferrably, base 14 is vertically oriented as secured to a vertically extending structure.

Operating lever 36 has a handle 37 formed at one end thereof, a shaft 38 having a generally rectangular cross sectional configuration and being integral and coaxial with handle 37, and a leg 39. Leg 39 has a generally rectangular cross sectional configuration corresponding to the cross sectional configuration of shaft 38 and is angled with respect to and integral with shaft 38. The degree at which leg 39 is angled with respect to shaft 38 may be varied to a relatively large degree without appreciably affecting the extent of crushing achieved with the device of the present invention, but leg 39 is preferrably angled at about 45° from shaft 38. It should be noted that shaft 38 and leg 39 are not cross sectionally offset with respect to each other so as to provide a smooth transition at the juncture thereof. A crushing shoe 40 is positioned at the free end of leg 39 and may be integrally formed therewith, such as by molding, or fixedly secured thereto via face 46, for example by welds.

Figure 2:
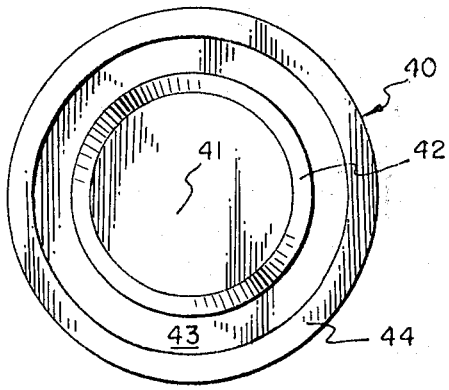
FIG. 2 is a plane view of one face of a crushing shoe utilized in the container crushing device of the present invention.

As illustrated in detail in FIG. 2, crushing shoe 40 is a generally circular disc having a substantially uniform thickness throughout. An annular groove 43 of substantially uniform depth is formed in face 48 thereby defining a raised central portion 41 and a raised outer, annular portion 44. The circular edge of central portion 41 is preferrably chamfered along substantially the entire circumference thereof. The chamfered edge 42 aids in positioning the raised outer edge of the end of a metal container within annular groove 43.

As assembled, operating lever 36 is pivotally secured to base 14 by means of pin 29. Lever 36 is positioned between support bars 24 and 26, an aperture through lever 36 is aligned with corresponding apertures in support bars 24 and 26, and pin 29 is inserted therethrough. Pin 29 may be fixed in this position by any suitable means, such as a cotter pin or by interference with the apertures in support bars 24 and 26. As so assembled, support bars 24 and 26 serve as a fulcrum about which operating lever 36 pivots. Preferrably, bars 24 and 26 are provided with a plurality of apertures 27 and 28 to allow crushing shoe 40 to receive and crush metal containers of different heights. Although the pin and aperture arrangement just described is the preferred manner of pivotally securing operating lever 36 to base 14, any other suitable means for pivotally securing the same at differing heights, may be employed in the container crushing device of the present invention.

Figure 3A:
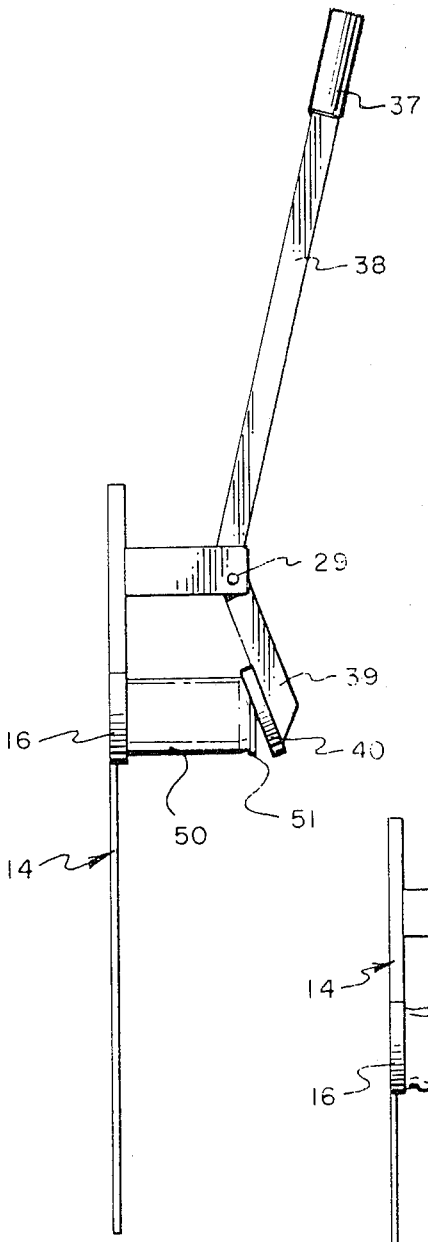
FIGS. 3*a, b* and *c* are side views of the container crushing device of the present invention depicting the sequence occurring during the crushing of a container by the container crushing device.
Figure 3B:
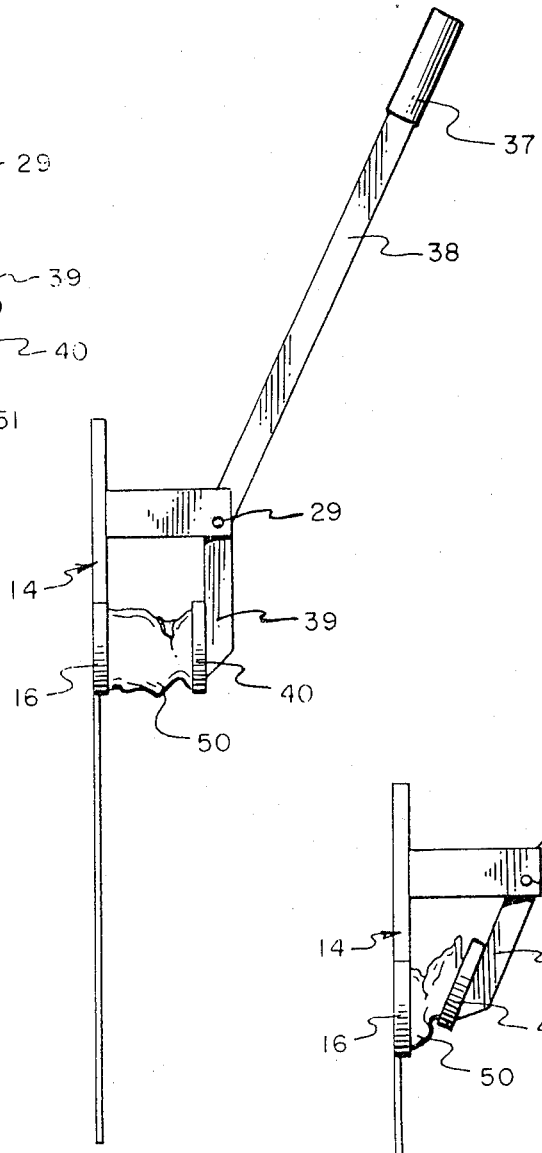
Figure 3C:
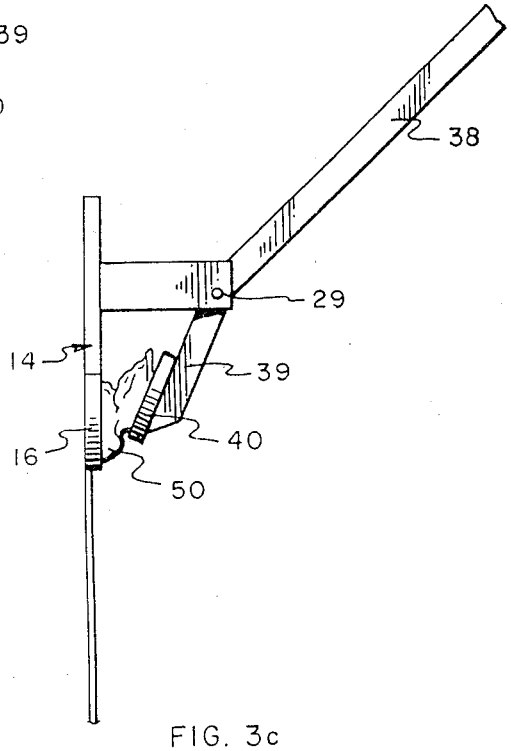

Turning now to FIGS. 3*a, b* and *c*, the operation of the container crushing device of the present invention is illustrated. Base 14 is fixedly secured to a structure, for example, by wood screws inserted through bores 30, 31 and 32 (FIG. 1) and mated with the structure. Base 14 is preferrably fixedly secured to a vertically extending structure and vertically oriented on the structure. The operator grasps handle 37 and pushes the handle a sufficient distance so as to position crushing shoe 40 in such a manner that one end of metal container 50 may be positioned within base shoe 16. Once metal container 50 is so positioned by the operator, the operator pulls handle 37 while manually maintaining the one container end positioned within base shoe 16 until one edge of the other end of metal container 50 is positioned within annular groove 43 within crushing shoe 40, as illustrated in FIG. 3*a*. Chamfered edge 42 will aid in guiding the edge of metal container 50 within annular groove 43. Thus, while the operator maintains force on handle 37, the metal container is retained in the position illustrated in FIG. 3*a* by means of sidewall 19 of base shoe 16 and groove 43 of crushing shoe 40. Thereafter, the operator pulls handle 37 downwardly, initially forcing the other end of the metal container within annular groove 43 of crushing shoe 40 while causing some crushing of the body of the metal container (FIG. 3*b*). The operator continually pulls handle 37 thereby moving crushing shoe 40 toward base shoe 16 until crushing shoe 40 becomes firmly embedded in crushed can 50 (FIG. 3*c*). Preferrably crushing shoe 40 is offset from and angled with respect to base shoe 16 at the end of the crushing stroke. It has been found that the crushed container resulting from such relative orientation of the base shoe 16 and crushing shoe 40 has a smaller bulk than a container crushed by fully mating shoes. Once the container has been crushed (FIG. 3*c*), the operator pushes handle 37 which in turn moves crushing shoe 40 from contact with crushed metal container 50 thereby allowing crushed container 50 to fall by gravitational force from base shoe 16. Thus, the crushed metal container 50 which usually has numerous sharp and protruding edges does not have to be handled by the operator, and thus, risk of physical injury is minimized.

Figure 4:
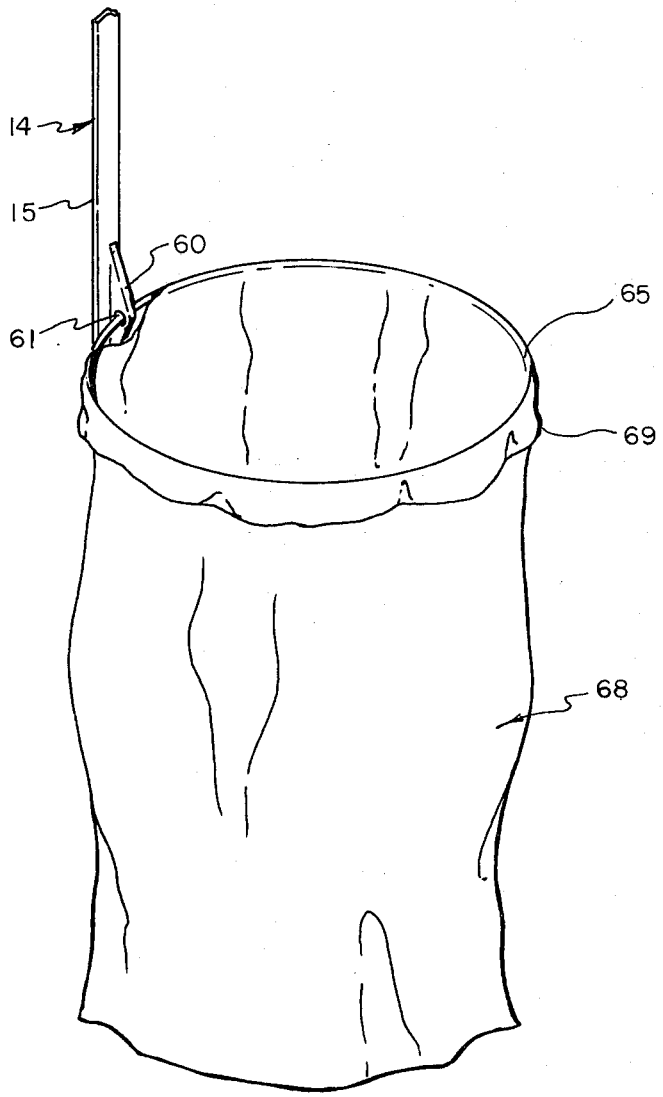
FIG. 4 is a partially cut away, side view of a container crushing device of the present invention which includes means for collecting crushed cans.

To provide for collection of crushed metal containers without manual handling thereof, means for collecting crushed containers may be provided. One such collection means is illustrated in FIG. 4. As illustrated, a hoop 65 is inserted through a bore 61 formed within projection 60. Projection 60 may be fixedly secured to base 14 adjacent the lower end thereof as mounted to structure, for example by welds, or may be integrally formed with base 14, such as by molding. Hoop 65 extends perpendicularly from base 14, and hence, in a substantially horizontal plane when base 14 is vertically orientated and mounted on a verticle structure. Hoop 65 may be secured against relative movement with respect to base 14 by any suitable means, such as, for example by welds or a tongue and groove arrangement. A conventional trash bag 68, such as a plastic trash bag, is inserted through hoop 65 and the upper end 69 of trash bag 68 wrapped around hoop 65 to relasably secure bag 68 thereto. Thus, crushed containers fall from base shoe 16 into trash bag 68. Once the trash bag is filled with crushed containers, the bag is removed and a suitable tie utilized to close the open end thereof. By utilizing a collector such as the one illustrated in FIG. 4, the operator of the device of the present invention does not have to handle crushed cans, and therefore, physical injury is minimized.

The container crushing device of the present invention may be constructed of any material which possesses the structural strength necessary to crush metal containers. And while alternative forms of construction have been indicated throughout the foregoing description, the container crushing device is preferrably formed by separately molding base 14 and and operating lever 36 to ensure structural integrity of the device.

While various embodiments and modifications of this invention have been described in the foregoing description, further modifications will be apparent to those skilled in the art. Such modifications are included within the scope of this invention as defined by the following claims.

I claim:

1. A device for crushing a metal container to reduce the bulk of the container and facilitate recycling for the metal content of the container, the container having a pair of opposed ends, said device comprising:

a generally circular base plate;

an annular retaining ring integral with said circular base plate and having a substantially identical peripheral configuration as said circular base plate, said annular retaining ring being sized to receive one of said pair of opposed ends therethrough;

base means for securing said circular base plate and said annular retaining ring against relative movement;

a generally circular disk of substantially uniform thickness having an annular groove formed in one face thereof, said annular groove capable of receiving the other of said pair of opposed ends and defining a raised central portion and a raised outer, annular portion, the circular edge of said central portion being chamfered along substantially the entire circumference thereof to aid in positioning said other said pair of opposed ends within said annular groove; and an operating lever pivotally secured to said securing base means and having said generally circular disk fixedly secured to one end thereof, said operating lever being angled intermediate the length thereof and being pivotally secured to said securing base means at the position where said lever is angled, said lever being operable to secure said container against movement in a first position when said one of said pair of opposed ends is received through said annular retaining ring and said other of said pair of opposed ends is positioned within said annular groove, said lever capable of manipulating said circular disk in a relatively axial direction with respect to said circular base plate to a second position wherein said container is crushed, said circular disk being offset from and angeled with respect to said circular base plate in said second position to crush said container into relatively small bulk, and said lever capable of manipulating said circular disk away from said circular base plate to permit movement of said crushed container with respect to said circular disk and said circular base plate due to gravitational force.

2. The container crushing device of claim 1 wherein said securing base means includes:

a pair of support arms fixedly secured to said securing base means at one end of each of said pair and extending outwardly from said securing base means, said operating lever being pivotally secured to the other end of each of said pair.

3. The container crushing device of claim 1 further comprising:

means for collecting said crushed containers moving from said circular disk and said circular base plate due to gravitational force.

4. The container crushing device of claim 1 further comprising:

means for positioning said circular disk with respect to said circular base plate so that a second container of a different height than said container can be crushed in said second position.

5. A device for crushing a generally cylindrical metal container to reduce the bulk of and facilitate recycling for the metal content of the container, the container having a pair of opposed, generally circular ends, said device comprising:

a first enlongated strip of material having a relatively uniform thickness and at least one aperture therethrough for fixedly securing said first enlongated strip to a structure;

a second elongated strip of material having a relatively uniform thickness and having at least one aperture therethrough for fixedly securing said second elongated strip to said structure;

a base shoe positioned intermediate and fixedly secured to said first and said second elongated strips, said base shoe having a generally circular base plate and an annular retaining ring integral with said circular base plate and having a substantially identical peripheral configuration as said circular base plate, said annular retaining ring being sized to receive said one of said pair of opposed ends therethrough;

a pair of support arms having one end thereof fixedly secured to said second elongated strip intermediate the length thereof, said pair of support arms being substantially parallel and extending in a generally perpendicular manner from said second elongated strip;

an operating lever angeled along the length thereof and positioned between and pivotally secured to said pair of support arms at the position where said lever is angled; and a generally circular disc secured to one end of said operating lever, said disc being of substantially uniform thickness and having an annular groove formed in one face thereof, said annular groove capable of receiving said other of said pair of opposed ends and defining a raised central portion and a raised outer, annular portion, the circular edge of said central portion being chamfered along substantially the entire circumference thereof to aid in positioning said other of said pair of opposed ends within said annular groove.

6. The container crushing device of claim 5 wherein each of said pair of support arms has at least one aperture therethrough which is axially aligned with said at least one aperture of the other of said pair of support arms, said operating level having an aperture therethrough and pivotally secured to said pair by means of a pin fixedly positioned through said aligned apertures of said support arms and said aperture of said operating lever.

7. The container crushing device of claim 5 further comprising:

a hoop secured to said first elongated strip in a perpendicular manner.

* * * * *